US005259510A

United States Patent [19]

Lowe et al.

[11] Patent Number: 5,259,510

[45] Date of Patent: Nov. 9, 1993

[54] APPARATUS FOR SEPARATING AND REMOVING FINE PARTICULATES FROM A PARTICLE FLOW

[75] Inventors: Henry E. Lowe, Arcadia, Fla.; Clayton C. Nelson, Granger, Ind.

[73] Assignee: Edward Lowe Industries, Inc., Cassopolis, Mich.

[21] Appl. No.: 861,269

[22] Filed: Mar. 31, 1992

[51] Int. Cl.[5] ..... B07B 4/00

[52] U.S. Cl. ..... 209/134; 209/153; 209/640

[58] Field of Search ..... 209/134, 153, 638-640, 209/642, 643, 138

[56] References Cited

U.S. PATENT DOCUMENTS

| | | | |
|---|---|---|---|
| 111,323 | 1/1871 | Crawford . | |
| 329,238 | 10/1885 | Spitzer . | |
| 393,981 | 12/1888 | Hunter | 209/153 |
| 990,157 | 4/1911 | Morscher . | |
| 1,491,429 | 4/1924 | Stebbins . | |
| 1,546,132 | 7/1925 | Heishman . | |
| 2,302,112 | 12/1942 | Eddy et al. . | |
| 3,024,907 | 3/1962 | Carruthers | 209/153 |
| 3,468,417 | 9/1969 | Zollinger | 209/642 |
| 3,473,659 | 10/1969 | Berticevich et al. . | |
| 3,818,822 | 6/1974 | Rehder . | |
| 3,946,875 | 3/1976 | Fowler . | |
| 4,242,197 | 12/1980 | Voelskow et al. | 209/153 |
| 4,277,273 | 7/1981 | Legilk et al. | 209/153 |
| 4,335,151 | 6/1982 | Caubet . | |
| 4,568,453 | 2/1986 | Lowe . | |
| 4,662,274 | 5/1987 | Nonomiya . | |
| 4,701,256 | 10/1987 | Crass, Jr. | 209/153 |
| 4,744,470 | 5/1988 | Feller et al. . | |
| 4,857,178 | 8/1989 | Barthelmess . | |
| 4,915,824 | 4/1990 | Surtees | 209/153 |

FOREIGN PATENT DOCUMENTS

| | | | |
|---|---|---|---|
| 51069 | 12/1911 | Austria | 209/153 |
| 251412 | 1/1988 | European Pat. Off. | 209/640 |
| 522230 | 4/1931 | Fed. Rep. of Germany | 209/153 |
| 722611 | 4/1980 | U.S.S.R. | 209/134 |
| 1119744 | 10/1984 | U.S.S.R. | 209/134 |
| 1210704 | 2/1986 | U.S.S.R. | 209/642 |
| 1287955 | 2/1987 | U.S.S.R. | 209/153 |
| 1592059 | 9/1990 | U.S.S.R. | 209/642 |

*Primary Examiner*—Robert P. Olszewski
*Assistant Examiner*—Steven M. Reiss
*Attorney, Agent, or Firm*—Laff, Whitesel, Conte & Saret

[57] ABSTRACT

An apparatus for separating fine particulates from a particle flow having a generally vertically disposed column with a particle flow channel. A particle flow inlet and outlet are located at opposite ends of the column in which an airstream is produced. Alternatively arranged downwardly slopping baffles are exposed on opposite sides of the channel for receiving and distributing the particle flow to the airstream. Each successive baffle is longitudinally spaced from the previous baffle. A mechanism is provided adjacent the bottom of each baffle for fanning out the particle flow and for removing the fine particulates from the fanned out particle flow into the airstream.

35 Claims, 2 Drawing Sheets

APPARATUS FOR SEPARATING AND REMOVING FINE PARTICULATES FROM A PARTICLE FLOW

FIELD OF THE INVENTION

This invention relates to an apparatus and method for separating fine particulates from a particle flow. More particularly, this invention relates to an apparatus and method for separating fine particulates from a particle flow which involves fanning out the fine particulates into an airstream.

BACKGROUND OF THE INVENTION

Industry is beset by unwanted dust or very small particulates which either intermix with or adhere to larger particles or particulate material. In the first instance, the small intermixed particulates are not adhesively attached to the larger particulate material and therefore have a tendency to become airborne when the larger particulate material is transferred or transported. This may create an undesirable condition in that it may be unhealthy to breath the airborne particles. This concern is especially prevalent in the grain handling or milling industries and also in mining, quarrying and processing of minerals.

In the latter instance, instead of intermixing, the small particulates often adhere to the larger particulate materials by static charge, moisture or physical impingement. This typically occurs during the processing of the particulate material wherein small particulates are generated by the friction between the particles themselves or with equipment surfaces. Such an occurrence often renders the larger particulate material less suitable for its intended use. For example, in the clay industry, particulate material is prepared for a variety of uses, including for oil and grease absorption or for use as animal litter. If, during the processing of these materials, the fine particulates adhere to the larger particles, the ability of the larger particulates to absorb oil and grease or to effectively neutralize odor (in the case of animal litter) is diminished.

For purposes of the explanation which follows, the larger particulate material will be referred to as "particles" and the smaller particulate material or fines will be referred to as "particulates".

Thus, a variety of devices for separating small particulates from larger particles have been developed. These devices are generally known as dedusters. Some of these dedusters separate the different sized particles and particulates by initially moving them through interconnected chambers with air and then subsequently subjecting them to machine-operated components for the actual separation of the particles. See U.S. Pat. Nos. 4,335,151; 4,857,178. Other dedusters separate particles by a combination of abrasive impact and air movement. One device in particular is disclosed in U.S. Pat. No. 4,568,453 wherein a stream of particles and particulates cascades down a series of baffles while being exposed to a vacuum airstream which separates and removes the particles.

While the aforementioned prior art deduster devices separate some of the particulates from the larger particles, there are problems associated with their use, as explained below.

First, the known deduster devices are generally ineffective in separating small particulates that are intermixed with larger particles in that many of the small particulates are not accessible to the vacuum airstream or other removal means.

Second, the known deduster devices are also ineffective in separating particles that are adhered to one another. This may be due, in some instances, to an electrostatic charge between the particles, which usually interferes with the separation of the particles in that the electrostatically charged particles cling to adjacent particles and thereby resist the vacuum airstream. This situation is commonly a problem with devices that utilize only an airstream for particle separation. In other instances, the ineffectiveness of the known deduster devices in separating adhered particulates may be attributed to the inferior or inadequate abrasion techniques in these dedusters which do not adequately dislodge the small particulates from the larger particles for their subsequent removal.

Aside from the aforementioned problems associated with separating particulates, there are other serious drawbacks and disadvantages with the known deduster devices. For example, many known deduster devices require external energy sources for operating their various components, including mechanisms for abrading and for impacting the combined particle and particulate matter. Furthermore, the deduster devices which include external energy sources generally have elevated operation costs and generally require excessive amounts of space when assembled.

Despite the numerous disadvantages with the abovementioned dedusting devices, they are still widely used. Thus, while these dedusting devices produce some dust-free material, they often do not effectively meet stringent dust-free standards.

Accordingly, an object of the present invention is to provide an apparatus that separates fine particulates from a particle flow and which produces substantially dust free material.

Another object of the present invention is to provide an apparatus that separates fine particulates from a particle flow by transforming the linear momentum of the combined particle and particulate flow to angular momentum thereby spreading the flow out into a fan to facilitate the separation process.

Another object of the present invention is to provide an apparatus that separates fine particulates from a particle flow without using motorized components.

Yet another object of the present invention is to provide an apparatus that separates fine particulates from a particle flow which is economical to operate and which requires a relatively limited amount of space.

SUMMARY OF THE INVENTION

The present invention, in a preferred embodiment, accomplishes the foregoing objects by providing an apparatus and a method for separating fine particulates from a particle flow for their removal by an airstream that comprises, in part, alternately arranged baffles disposed on opposite sides of the apparatus for receiving and directing the particle flow into rotatable means which simultaneously transform the linear momentum of the particle flow as it cascades down the baffles to angular momentum thereby fanning out the fine particulates into the vacuum airstream. In a preferred embodiment, the rotatable means comprise a first rotatable member which predominantly directs the particle flow into an adjacently and inwardly positioned second rotatable member which, in combination with the first rotatable member, causes the fine particulates to fan out from the particle flow for removal by the vacuum airstream.

The first and second rotatable members are not motorized. Rather, the particle flow from the baffles drives the first rotatable member which transmits the movement to the second rotatable member, which together dislodge the smaller particulates causing them to become airborne, and to be caught up in the vacuum airstream.

The rotatable members preferably include a napped surface preferably having a plastic or metal wire screening to provide abrasiveness.

The above, as well as other objects and advantages of the invention, will become apparent from the following detailed description of the preferred embodiments, reference being made to the accompanying drawings.

DETAILED DESCRIPTION OF THE INVENTION

Figure 1:
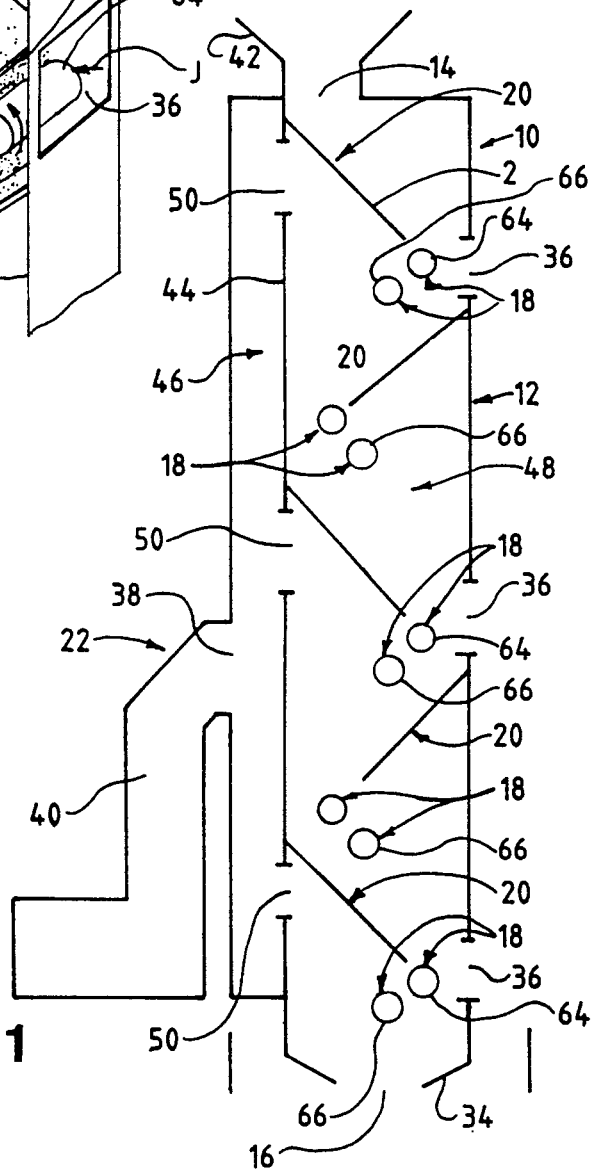
FIG. 1 is a cross-sectional view of the preferred embodiment of the inventive dedusting apparatus.

Generally referring to FIG. 1, the invention provides an apparatus, denoted by the numeral 10, for separating fine particulates from a particle flow having, in part, a generally rectangular body or column 12 with a material flow inlet 14 and a material flow outlet 16 that includes rotatable means 18 for transforming the linear momentum of the particle flow by imparting differing angular momentum to the differently weighted particles thereby fanning out the fine particulates from the particle flow. Alternately arranged baffles 20 are disposed on opposite sides of the column for receiving and distributing the particle flow into the rotatable means. A vacuum source 22 creates an air flow transverse to the path of the particle flow for removing the fine particulates from the particle fan.

Figure 2:
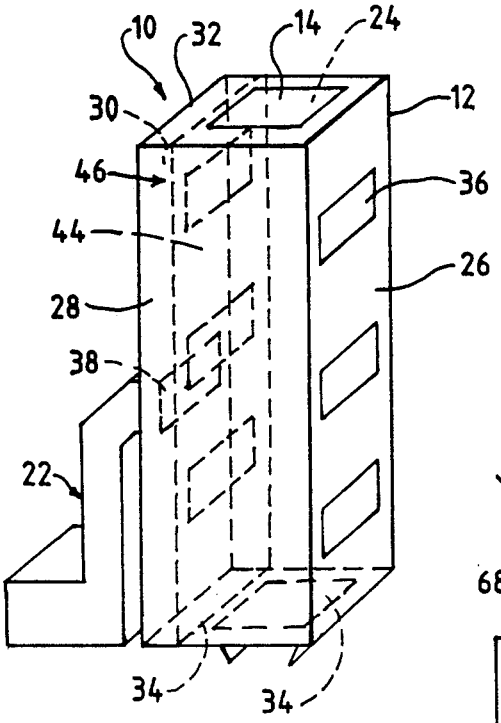
FIG. 2 is a perspective view of the apparatus of FIG. 1.

Referring to FIGS. 1 and 2, body 12 is generally enclosed and includes a first, second, third and fourth side, 24, 26, 28, 30, respectively, a top portion 32 and a bottom portion 34. Side 26 includes a plurality of generally uniformly spaced air intake openings 36 whereas opposite side 28 of body 12 includes a vacuum opening 38 that is connected to a vacuum source 40. Likewise, top portion 32 includes material flow inlet 14 to which is attached a supply conduit 42 for storing the particulate and particle material. Bottom portion 34 includes a gradually sloping surface which is inclined towards a centrally located material flow outlet 16.

A partition 44 dissects body 12 into a vacuum chamber 46 and a dust-removing particle flow channel 48 that communicate with one another through a plurality of uniformly spaced air outlet openings 50 (see FIGS. 1 and 4) that are located on partition 44. Vacuum chamber 46 is generally elongated and is devoid of any internal components whereas particle flow channel 48 includes rotatable means 18 and baffles 20. The aforementioned material flow inlet 14 and material flow outlet 16 are located in the portion of top portion 32 and bottom portion 34 which covers particle flow channel 48 and not vacuum chamber 46.

Figure 4:
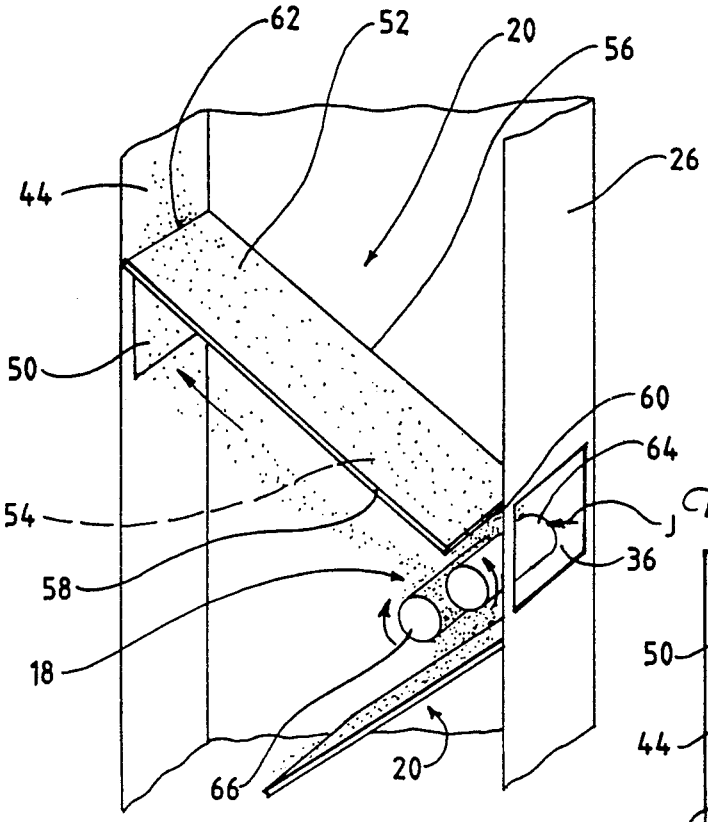
FIG. 4 is a partial perspective view of the apparatus of FIG. 3, also illustrating the movement of the particle flow.
Figure 3:
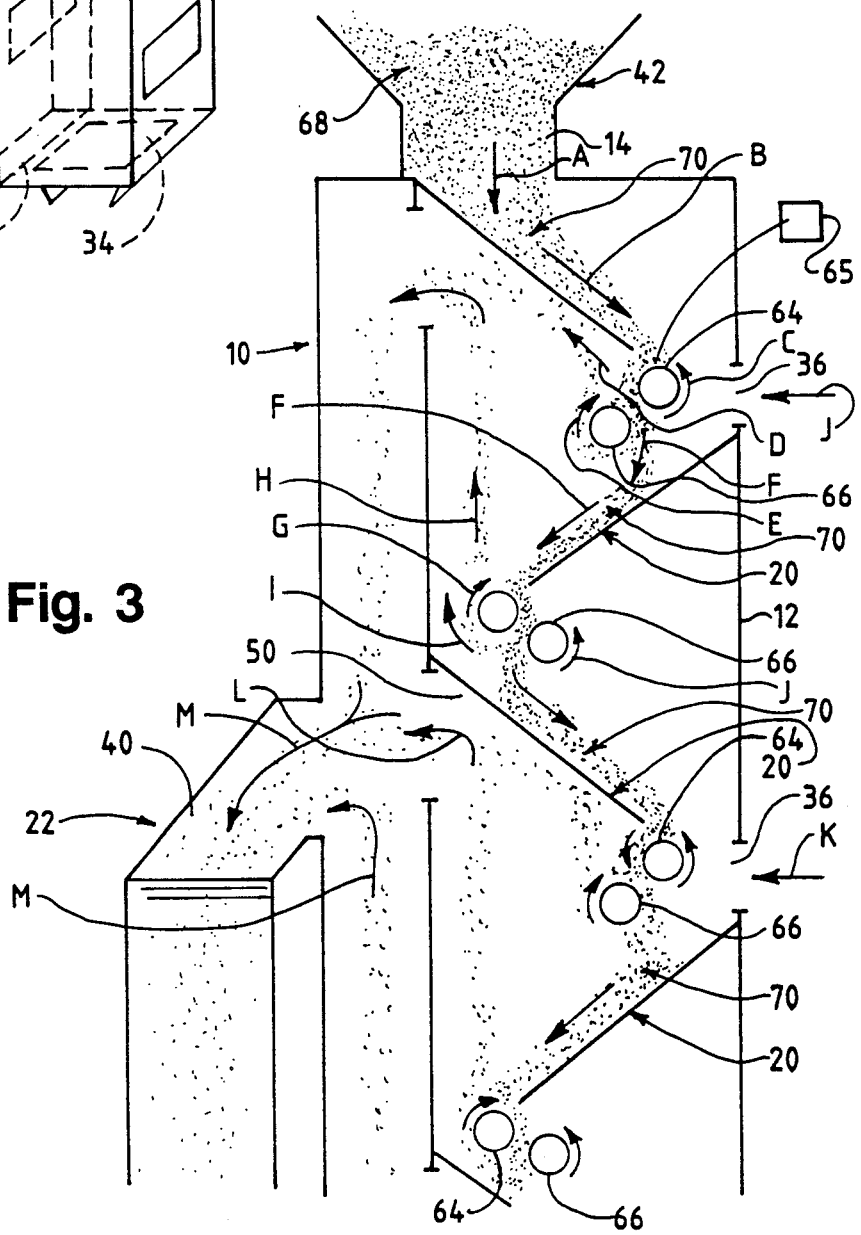
FIG. 3 is a partial cross-sectional schematic view of the apparatus of FIG. 1, illustrating the particle flow as it moves through the apparatus.

As shown in FIGS. 1, 3 and 4, baffles 20 are alternately arranged and fixedly disposed on opposite sides of particle flow channel 48. Each baffle is generally rectangular in shape and includes a top surface 52, a bottom surface 54, a first side 56, a second side 58, a lower edge 60 and an upper edge 62. Baffles 20 are typically welded to partition 44 and side 26 along upper edge 62. First and second sides, 56, 58, respectively, of baffles 20 are parallel to sides 24 and 28 of body 12.

Baffles 20 slope downwardly and inwardly at approximately a 45 degree angle and are each longitudinally spaced from the previous baffle. Lower edge 60 of each of baffles 20 remotely overlaps top surface 52 of the successive baffle so that the particulate material that is introduced into particle flow channel 48 must follow a circuitous route from material flow inlet 14 to material flow outlet 16.

Adjacent to and directly above upper edge 62 of each of the baffles at their point of attachment to side 26 of body 12 are a plurality of evenly spaced air intake openings 36. Likewise, adjacent to and directly beneath upper edge 62 of each of the baffles at their point of attachment to partition 44, are the previously mentioned air outlet openings 50.

Immediately adjacent lower edge 60 of baffles 20 are rotatable means 18 which are pivotally attached by any suitable fastening means to side 24 of body 12. Rotatable means 18 are generally elongated cylinders (see FIG. 4) and preferably include a first rotatable member 64 and a second rotatable member 66 which is adjacent to and positioned inwardly relative to the first rotatable member. Both rotatable members are positioned below lower edge 60 of baffles 20 with first rotatable member 64 being positioned at approximately a twenty degree angle from the longitudinal axis of baffle 20 and second rotatable member 66 being positioned out approximately a forty-five degree angle from the longitudinal axis of the same baffle.

First and second rotatable members, 64, 66, respectively, rotate in opposite directions from one another with first rotatable member 64 generally rotating inwardly towards the adjacently located baffle and second rotatable member 66 rotating outwardly away from the same baffle. Their rotational direction is thus directly related to their position relative to the longitudinal axis of the closest baffle.

First and second rotatable members, 64, 66, respectively, each may include a "fur-like" surface, a nap, a foam surface or any variety of other surfaces, each of which may be covered with plastic or metal wire screening to provide abrasiveness. Moreover, a liquid may be provided from a liquid supply 65 to the surface of the rotatable members for coating the particle flow, if desired.

In the use and operation of the preferred embodiment of the present invention, a plurality of stored particles and particulates 68 are fed from supply conduit 42 into particle flow channel 48 through material flow inlet 14, in the direction indicated by arrow A, where they form a downwardly cascading particle flow 70 of intermixed and/or adhered small particulates and large particles. As soon as particle flow 70 passes through inlet 14, it impacts with and gravitationally moves down the uppermost baffle 72 towards lower edge 60, in the direction indicated by arrow B. During its gravitational movement down the baffle, particle flow 70 gathers linear momentum.

As particle flow 70 moves beyond lower edge 60 of uppermost baffle 72 it impacts against the longitudinal surface of first rotatable means 64 causing several simultaneous occurrences. First, the linear momentum of particle flow 70 is transformed, at least in part, to angular momentum as the particle flow is deflected in a different direction of travel by the rotatable means. Second, the energy of the particle flow that is released as the particles strike the rotatable means causes first rotatable means 64 to rotate counterclockwise or inwardly towards baffle 72, as indicated by arrow C. Third, as particle flow 70 impacts with and rotates first rotatable member 64, the smaller particulates are dislodged from the larger particles causing them to become airborne, as indicated by arrow D. The larger particles are not airborne and continue their linear descent down the next successive baffle, as indicated by arrows E, whereupon they eventually impact with another first rotatable member 64. In the preferred embodiment, the uppermost baffle 72 includes only one rotatable member adjacent lower edge 60.

Similarly to the initial impact of particle flow 70 against the first rotatable member, this second impact again transforms at least some of the linear momentum of particle flow 70 to angular momentum as the particle flow changes its direction of travel and further causes first rotatable means 64 to rotate clockwise or inwardly towards the baffle, as indicated by arrow F. Again, as the particle flow impacts with the first rotatable member, the smaller particulates are dislodged from the larger particles and become airborne, as indicated by arrow G, while the larger particles are directed and accelerated towards and caused to impact against second rotatable member 66. This impact likewise simultaneously causes second rotatable member to rotate counterclockwise or in the opposite direction of the first rotatable member, as indicated by arrow I, while the smaller particulates become airborne, as indicated by arrow H.

In addition to and in combination with the foregoing, as particle flow 70 cascades down the successive baffles and impacts against the rotatable means, vacuum source 22 draws air through air intake openings 36 and into particle flow channel 48, in the direction indicated by arrow J, such that it traverses the path of the particle flow and passes into vacuum chamber 46 through air outlet openings 50, as indicated by arrows K. The air flow, in conjunction with the previously described impacting particle flow, causes the smaller airborne particulates to be carried out of particle flow channel 48, through vacuum chamber 46 and into vacuum 40, as indicated by arrows L.

The remaining particle flow continues down each successive baffle and impacts against the rotatable means in the same manner as described above until the smaller airborne particulates have been removed by the vacuum airflow and the remaining particle flow exits from material flow outlet 16. Because the energy of the particle flow propels the rotatable members, no external energy is required in the operation of the apparatus.

The material from which apparatus 10 is constructed may include any conventional metal or hard plastic for body 12 and baffles 20 and virtually any nap-like material for the rotatable members, such as foam or fur. Additionally, the rotatable members may be covered with plastic or metal wire or screening to provide abrasiveness. Moreover, apparatus 10 has not been described in terms of approximate measurements, as it should be understood that the dimensions of the apparatus may vary according to need.

Therefore, it should be recognized that, while the invention has been described in relation to a preferred embodiment thereof, those skilled in the art may develop a wide variation of structural details without departing from the principles of the invention. Accordingly, the appended claims are to be construed to cover all equivalents falling within the scope and spirit of the invention.

The invention claimed is:

1. An apparatus for separating fine particulates from a particle flow for their removal by an airstream comprising:

a generally vertically disposed column including a particle flow channel therein and having a particle flow inlet and a particle flow outlet at opposite ends of said column;

means for producing an airstream in said column;

alternatively arranged downwardly sloping baffles disposed on opposite sides of said channel for receiving and distributing the particle flow into the airstream, each successive baffle being longitudinally spaced from the previous baffle; and means, located adjacent the bottom of each baffle and driven by the particle flow, for fanning out the particle flow to facilitate removal by the airstream of fine particulates from the fanned out particle flow.

2. The apparatus of claim 1 further comprising air intake openings disposed between said baffles on one side of said column and air outlet openings disposed between said baffles on an opposite side of said column.

3. The apparatus of claim 2 wherein said airstream comprises a vacuum source for creating a stream of air from said intake openings to said outlet openings, said airstream being generally transverse to the particle flow.

4. The apparatus of claim 1 wherein said fanning means comprises a first rotatable member.

5. The apparatus of claim 4 wherein said fanning means further comprises a second rotatable member for accepting the particle flow from said first rotatable member and for fanning out the fine particulates from the particle flow, said second rotatable member being adjacent to said first rotatable member.

6. The apparatus of claim 5 wherein said second rotatable member comprises a napped surface.

7. The apparatus of claim 6 wherein said napped surface of said second rotatable member includes means which provide abrasiveness.

8. The apparatus of claim 7 wherein said abrasiveness means comprises a metal screen.

9. The apparatus of claim 5 wherein said first rotatable member accelerates the movement of the particle flow to said second rotatable member.

10. The apparatus of claim 4 wherein said second rotatable member is positioned adjacent to said first rotatable member at approximately a 45 degree angle from a longitudinal axis of said baffles.

11. The apparatus of claim 5 wherein said second rotatable member is rotated by the particle flow.

12. The apparatus of claim 5 wherein said second rotatable member comprises a solvent material on its surface.

13. The apparatus of claim 5 wherein said second rotatable member rotates away from the adjacent baffle.

14. The apparatus of claim 5 wherein said second rotatable member rotates in a direction opposite to said first rotatable member.

15. The apparatus of claim 1 wherein said first rotatable member comprises a napped surface.

16. The apparatus of claim 15 wherein said napped surface of said first rotatable member includes means which provide abrasiveness.

17. The apparatus of claim 16 wherein said abrasiveness means comprises a metal screen.

18. The apparatus of claim 1 wherein said first rotatable member comprises a solvent material on its surface.

19. The apparatus of claim 1 wherein said air intake openings are disposed on a side of said column adjacent said first movable member.

20. The apparatus of claim 1 wherein said air outlet openings are disposed on said opposite side of said column beneath said baffles.

21. The apparatus of claim 1 wherein said first rotatable member directs the particle flow from each successive baffle to the next.

22. The apparatus of claim 1 wherein said first rotatable member is positioned below said baffle at approximately a 20 degree angle from a longitudinal axis of said baffles.

23. The apparatus of claim 1 wherein said rotatable member is rotated by the particle flow.

24. The apparatus of claim 4 wherein said first rotatable member rotates toward the adjacent baffle.

25. An apparatus for separating fine particulates from a particle flow for their removal by an airstream, said apparatus comprising a generally vertically disposed column including a particle flow channel therein and having a particle flow inlet and a particle flow outlet at opposite ends of said column, means for producing an airstream in said column, alternately arranged downwardly sloping baffles disposed on opposite sides of said channel for receiving and distributing the particle flow into the airstream, each successive baffle being longitudinally spaced from the previous baffle, the improvement comprising:

at least one rotatable member adjacent the bottom of each baffle, driven by the particle flow, for transforming the linear momentum of the particle flow to angular momentum thereby fanning out the fine particulates from the particle flow.

26. An apparatus for separating fine particulates from a particle flow for their removal by an airstream comprising:

a generally vertically disposed column including a particle flow channel therein and having a particle flow inlet and a particle flow outlet at opposite ends of said column;

means for producing an airstream in said column;

alternatively arranged downwardly sloping baffles disposed on opposite sides of said channel for receiving and distributing the particle flow into the airstream, each successive baffle being longitudinally spaced from the previous baffle; and first and second rotatable members, located adjacent the bottom of each baffle, said second rotatable member adjacent to said first rotatable member for accepting the particle flow from said first rotatable member and fanning out the fine particulates from the particle flow to facilitate removal by the airstream of fine particulates.

27. The apparatus of claim 26 wherein said second rotatable member is positioned adjacent to said first rotatable member at approximately a 45 degree angle from a longitudinal axis of said baffles.

28. The apparatus of claim 26 wherein said first rotatable member accelerates the movement of the particle flow to said second rotatable member.

29. The apparatus of claim 26 wherein said second rotatable member is rotated by the particle flow.

30. The apparatus of claim 26 wherein said second rotatable member rotates away from the adjacent baffle.

31. The apparatus of claim 26 wherein said second rotatable member rotates in a direction opposite to said first rotatable member.

32. The apparatus of claim 26 wherein said second rotatable member comprises a napped surface.

33. The apparatus of claim 26 wherein said second rotatable member comprises a solvent material on its surface.

34. The apparatus of claim 26 wherein said napped surface of said second rotatable member includes means which provide abrasiveness.

35. The apparatus of claim 34 wherein said abrasiveness means comprises a metal screen.

* * * * *